US006191398B1

(12) United States Patent
Peake et al.

(10) Patent No.: US 6,191,398 B1
(45) Date of Patent: Feb. 20, 2001

(54) DRY BATH TEMPERATURE CONTROL AND METHOD

(75) Inventors: Steven C. Peake; Jason A. Harms, both of Dubuque, IA (US)

(73) Assignee: Barnstead/Thermolyne Corporation, Dubuque, IA (US)

( * ) Notice: Under 35 U.S.C. 154(b), the term of this patent shall be extended for 0 days.

(21) Appl. No.: 09/394,267

(22) Filed: Sep. 10, 1999

(51) Int. Cl.[7] ..... H05B 1/02

(52) U.S. Cl. ..... 219/497; 219/521; 219/499; 219/506; 219/491; 422/307; 422/109

(58) Field of Search ..... 219/490, 491, 219/494, 497, 499, 501, 505, 506, 521; 422/65, 67, 109, 307; 432/49

(56) References Cited

U.S. PATENT DOCUMENTS

| | | | | |
|---|---|---|---|---|
| Re. 35,716 | * | 1/1998 | Stapleton et al. | 435/3 |
| 4,504,733 | | 3/1985 | Walsh . | |
| 5,224,536 | | 7/1993 | Eigen et al. . | |
| 5,399,840 | | 3/1995 | Goeddeke . | |
| 5,410,130 | | 4/1995 | Braunstein . | |
| 5,446,263 | | 8/1995 | Eigen et al. . | |
| 6,074,868 | * | 6/2000 | Blumenfeld | 435/286.1 |

* cited by examiner

*Primary Examiner*—Mark Paschall
(74) *Attorney, Agent, or Firm*—Wood, Herron & Evans L.L.P.

(57) ABSTRACT

A dry bath with a heat conductive block having a plurality of bores adapted to receive tubes containing samples of material. The dry bath includes a heater and a temperature sensor mounted to the block. A heat controller executes a control cycle of initially operating the heater to heat the block in the absence of the tubes to a desired temperature. Next, the heat controller automatically detects a change in temperature of the block in response to tubes being placed in the bores, wherein the samples in the tubes have a temperature different, for example, less, than the desired temperature. In that case, the heat controller operates the heater to first automatically heat the block to a temperature greater than the desired temperature. Thereafter, the heat controller automatically reduces the heat being applied to the block while heat continues to transfer to the samples such that the block and samples simultaneously reach, and are maintained at, the desired temperature. The dry bath may also include a fan and provides for other cycles of operation of the heat controller.

28 Claims, 5 Drawing Sheets

DRY BATH TEMPERATURE CONTROL AND METHOD

FIELD OF THE INVENTION

The present invention relates to dry baths and more particularly, to a dry bath temperature control.

BACKGROUND OF THE INVENTION

During the handling of samples of chemicals and other materials, it is often necessary to heat the samples to effect a desired reaction or result. The samples are often contained in vessels or tubes and, in some applications, are heated and/or cooled in a circulating water bath. The circulating water bath provides an excellent heat transfer medium in the form of water or water-like solutions. While water bath heaters perform very well, they have certain disadvantages with respect to their expense, potential cross-contamination issues, and the potential that water will escape the confines of the bath.

In other applications, the samples are heated and/or cooled in a dry bath. With a dry bath, a thermally conductive block, for example, an aluminum block, contains a plurality of blind holes into which the vessels or tubes containing the samples are inserted. Normally, an electric heater and temperature sensor are associated with the thermally conductive block. A heat control, for example, a stored program control, is utilized to provide a temperature set point to which the samples are to be heated. Different heat controls are known which control the operation of the heater as a function of the temperature set point and a temperature feedback provided by the temperature sensor. The heating cycle duration may be automatically controlled by a timer within the heat control or may be manually controlled by an operator physically removing the samples from the dry bath.

Dry baths have a significant disadvantage with respect to water baths in that the transfer of heat to and from the samples in a water bath is very efficient, and the heat transfer in dry baths is less efficient. Thus, operating cycles of a dry bath are often longer than equivalent operating cycles in a water bath. Some applications permit a temperature sensor to be mounted within the samples themselves. As can be seen in FIG. 8, in heating the samples to a selected temperature set point, for example, 60°, the temperature of the dry block supporting the samples may be heated to a temperature above the 60° temperature set point. With such direct monitoring, the sample temperature is accurately controlled, thereby providing for an efficient and relative short operating cycle. However, directly monitoring of sample temperature increases the risk of sample contamination and the risk of the sample escaping into the environment.

Therefore, in most applications, the temperature sensor is mounted with respect to, and measures the temperature of, the heater block supporting the samples. At the beginning of a heat control cycle, the operation of the electric heater is controlled to bring the temperature of the heater block to a desired temperature set point. Upon the samples being placed in the dry bath, the temperature of the samples is different, for example, less than the temperature of the heater block, thereby cooling the heater block to a temperature less than temperature set point. The heaters in the heater block are then operated to raise the temperature of the heater block and the samples to the desired set point temperature. However, the temperature of the samples lags the temperature of the heater block; and therefore, the temperature of the samples reaches the desired temperature set point at some time after the heater block achieves that temperature. Further, the temperature of the samples normally approaches the temperature set point of the heat block asymptotically as shown in FIG. 9. That is, as the temperature of the samples approaches the temperature set point, the rate at which the samples continues to change temperature drops significantly. Thus, the time required for the samples to reach the temperature set point is extended. Since many chemical, biological or DNA reactions are dependent on the samples being at the set point for a period of time, the process is optimized if the samples reach the temperature set point as quickly as possible.

Preferably, the temperature of the sample material within the tubes should be raised quickly and consistently to the temperature set point without overshoot. However, a relatively slow heat transfer from the block to the samples within the tubes results in a relatively slow thermal response within the sample. Thus there is a need for a dry bath temperature control providing an improved heat control cycle so that the samples reach the temperature set point as quickly as possible without overshoot.

SUMMARY OF THE INVENTION

The present invention provides an improved dry bath operating cycle, and thus, the dry bath of the present invention can more quickly change the temperature of samples to be equal to a desired temperature. The heat controller of the present invention results in an efficient operating cycle that brings the samples up to the set point temperature more quickly than known dry baths. The dry bath of the present invention provides a heat controller that provides an operating cycle that is comparable to a dry bath having a temperature sensor mounted in the sample itself. Further, the dry bath of the present invention provides the advantage of a heat transfer cycle that is comparable to a water bath without the disadvantages of a water bath.

In accordance with the principles of the present invention and the described embodiments, the invention provides a dry bath with a heat conductive block having a plurality of bores adapted to receive tubes containing samples of material. The dry bath includes a heater and a temperature sensor mounted in a heat transfer relation to the block, and a heat controller connected to the heater and the temperature sensor. The heat controller executes a control cycle of first automatically detecting a change, for example, a decrease, in the temperature of the block in response to the tubes containing samples being placed in the block, wherein the samples in the tubes have a temperature different from, for example, less than, the desired temperature. Thereafter, the heat controller automatically heats or cools, and in this example, heats the heat conductive block to a temperature different from, and in this example, greater than, a desired temperature, thereby transferring more heat to the samples in the tubes than if the block were heated to only the desired temperature. The heat controller then automatically changes, and in this example, reduces, the heat being applied to the block while continuing to transfer heat to the samples such that the block and samples simultaneously reach, and are maintained at, the desired temperature. Thus, the samples are heated to the desired temperature more quickly than if the block was maintained at the desired temperature.

In one aspect of the invention, the dry bath includes a cooling device mounted in a heat transfer relation to the block, temperature selector for selecting one of a plurality of desired temperatures and an indicator providing a signal that the temperature of the block is approximately equal to the selected temperature.

In another embodiment of the invention, the dry bath further includes a cooling device mounted in a heat transfer relation with the heat conductive block. The heat controller operates the heater and cooling device to provide an operating cycle that first automatically cools the heat conductive block to a temperature less than the desired temperature, thereby transferring more heat from the samples in the tubes than if the block were cooled to only the desired temperature. Thereafter, the heat controller automatically increases the heat being applied to the block while heat continues to be transferred from the samples such that the block and samples simultaneously reach, and are maintained at, the desired temperature. Thus, the samples are cooled to the desired temperature more quickly than if the block was maintained at the desired temperature.

In a further embodiment, the invention provides different methods of selectively operating a heater and a cooling device with the heat controller in response to different desired temperatures and in response to the dry bath receiving samples having temperatures different from the selected temperature.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
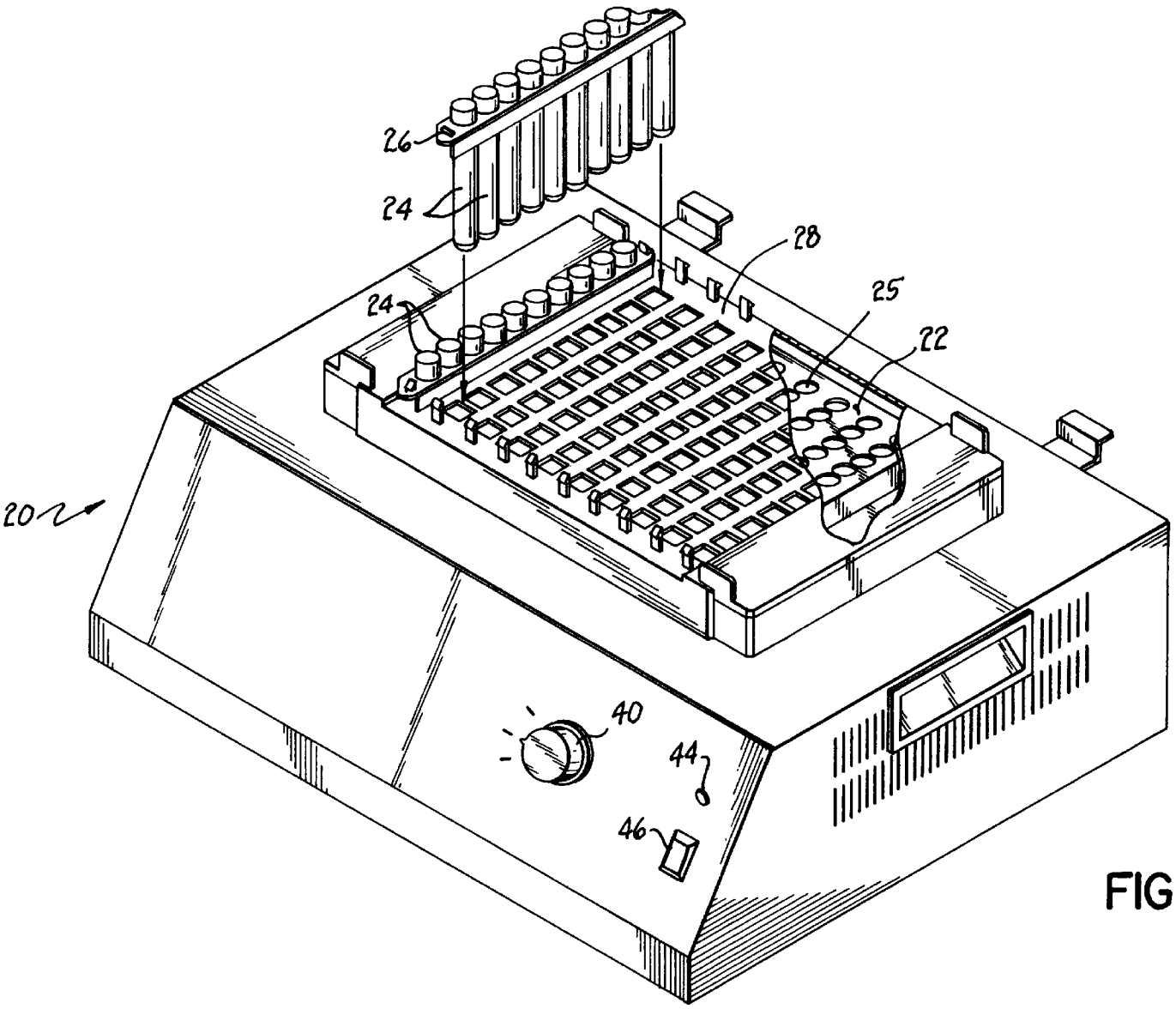
FIG. 1 is a perspective view of the dry bath in accordance with the principles of the present invention.
Figure 2:
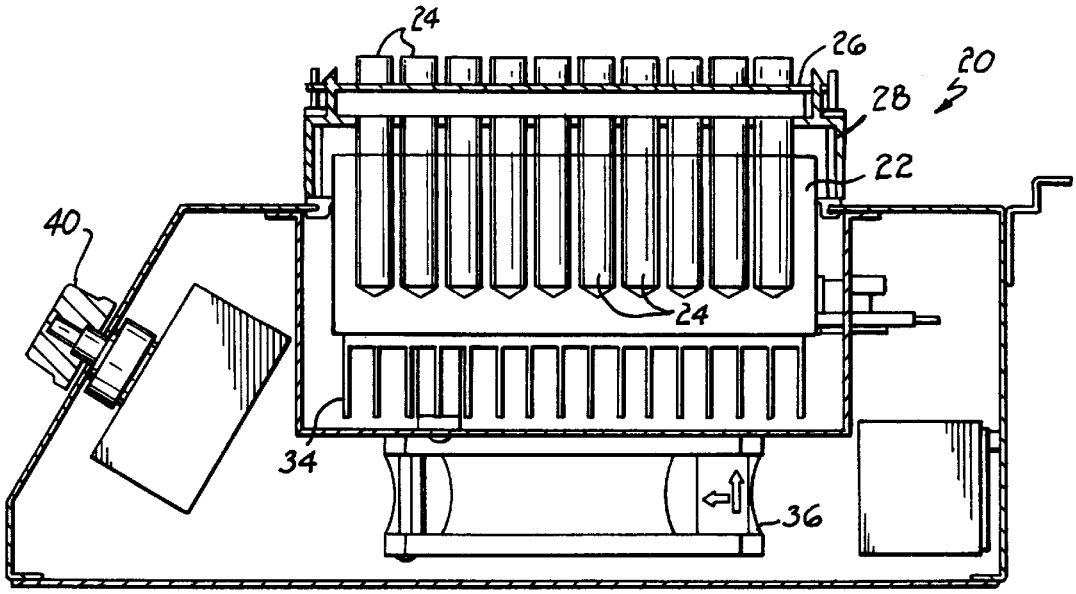
FIG. 2 is a cross-sectional view taken along the lines 2—2 of FIG. 1.

Referring to FIGS. 1 and 2, a dry bath 20 has a thermally conductive heat transfer block 22 that functions to add/remove heat from samples contained in vessels or tubes 24. The tubes 24 can include vials or any other sample containers of differing shape which can be placed in complementary shaped bores in the heat transfer block 22. The tubes 24 are often generally cylindrical and disposed within cylindrical blind holes 25 in the heat transfer block 22 and are removably supported in a rack 26, for example, a ten-tube rack. A number of racks 26, for example, ten racks, are removably attachable to a tray 28 that is removably mounted to the dry bath 20.

Figure 3:
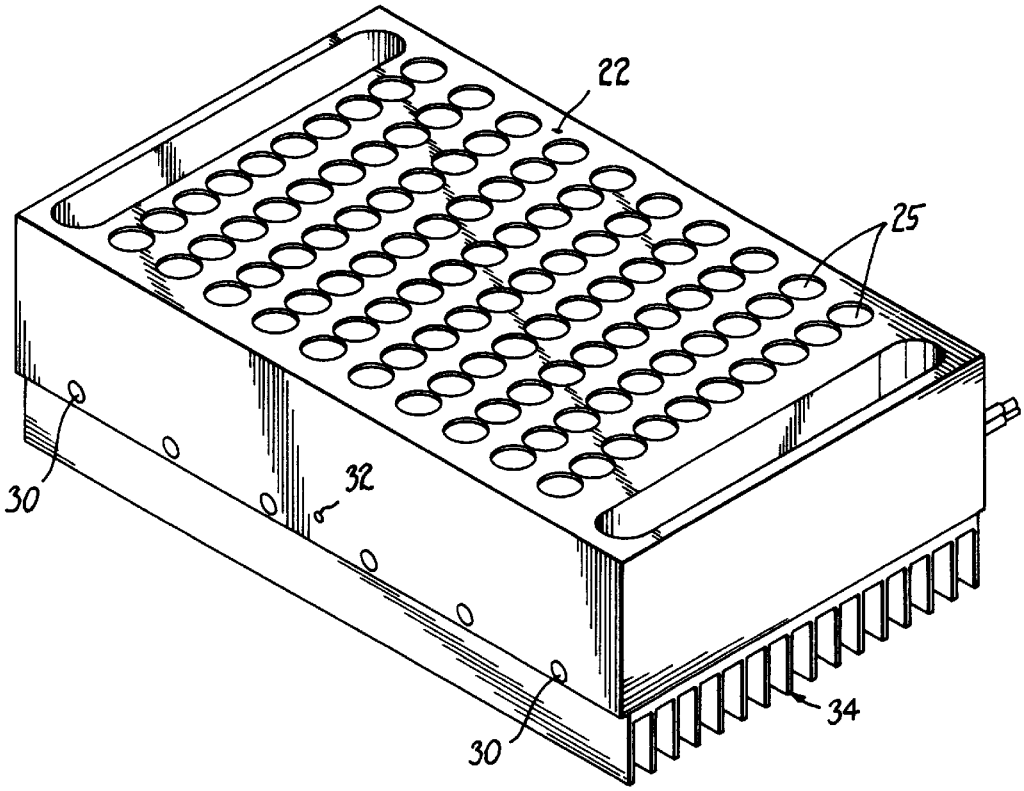
FIG. 3 is a perspective view of the heat transfer block utilized in the dry bath of FIG. 1.

Referring to FIGS. 2 and 3, one or more cartridge heaters 30 are in a heat transfer relationship with the heat transfer block 22 by being located in horizontal bores extending across the width at a lower portion of the heat transfer block 22. Cartridge heaters commercially available as Model No. E6A46 from Watlow of St. Louis, Mo., have been found to be satisfactory. A suitable temperature sensor 32, for example, a platinum resistance temperature device ("RTD") manufactured by Jumo Process Control, is commercially available from C&G Industrial Supply of St. Louis, Mo., as Catalog No. 90 255BA1. The temperature sensor 32 is also mounted in heat transfer relation to the heat conductive block, that is, within the heat transfer block 22, for sensing the temperature thereof. A heat sink 34 is attached to the bottom surface of the heat transfer block 22; and at least one electric fan 36 is mounted within the dry bath 20 adjacent the heat sink 34. The fan 36 is preferably mounted in heat transfer relation to the heat conductive block, for example, on the lower side of the heat sink 34, and forces ambient air in a vertically upward direction across the heat sink 34, thereby cooling the heat transfer block 22 and the substances within the tubes 24. A suitable axial fan manufactured by Papst is commercially available from Allied Electronics of Cedar Rapids, Iowa as Catalog No. 4600X. The heat transfer block 22 and heat sink 34 are made of aluminum, but copper or other heat conductive materials may also be used. Further, the heat transfer block 22 and heat sink 34 may be made of different heat conductive materials.

Figure 4:
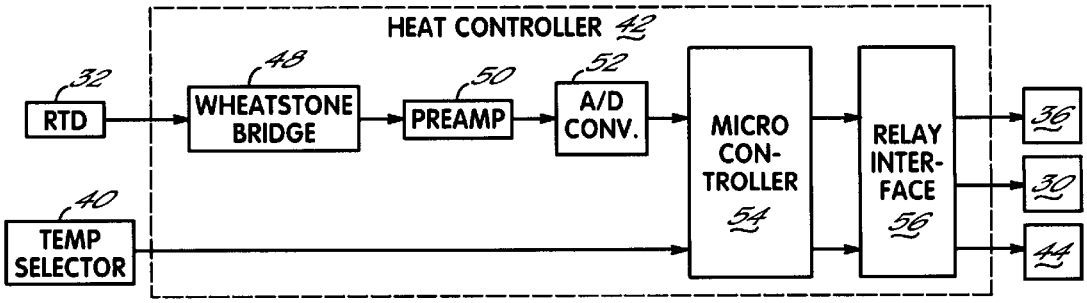
FIG. 4 is a schematic block diagram of the dry bath temperature control.
Figure 8:
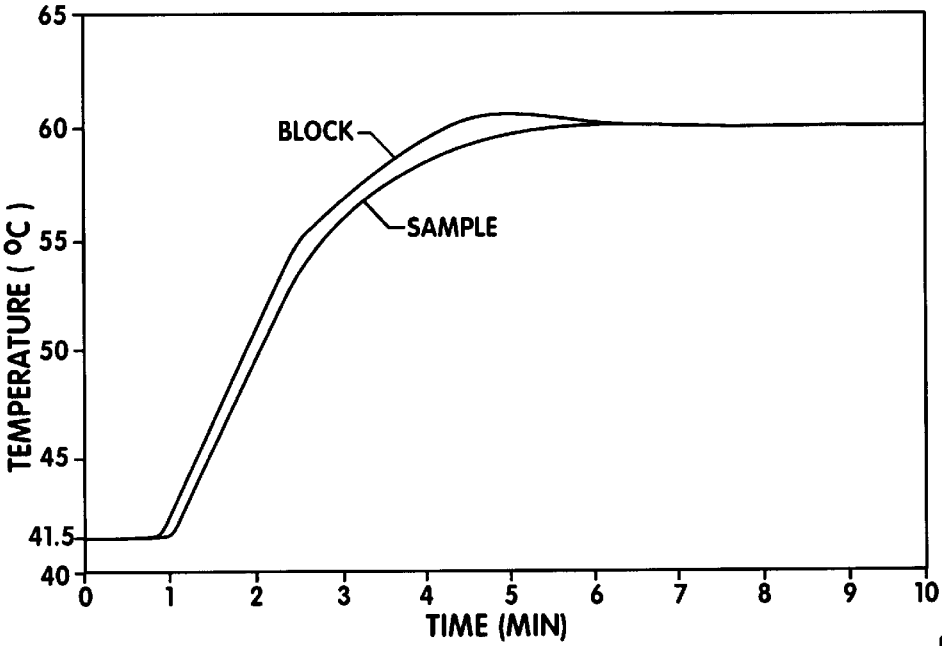
PRIOR ART FIG. 8
FIG. 8 is a graph plotting changes in temperature of the samples and the heater block during a cycle of operation of a known dry bath in which the temperature of the samples is controlled by a temperature sensor measuring the temperature of the samples instead of the heater block.
Figure 9:
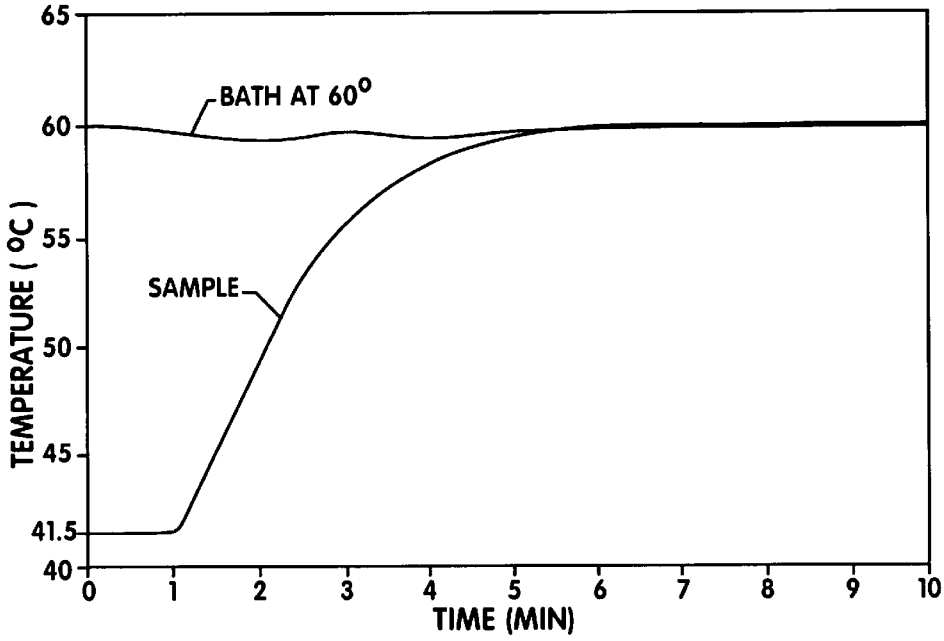
PRIOR ART FIG. 9
FIG. 9 is a graph plotting changes in temperature of the samples and the heater block during a cycle of operation of a known dry bath in which the temperature of the samples is controlled by a temperature sensor measuring the temperature of the heater block.

Referring to FIGS. 1 and 4, the dry bath 20 includes a temperature selector 40 which permits the user to choose or select one of a number of desired temperatures, for example, 41.5° C., 60° C. and 90° C., to which the samples are to be heated or cooled as necessary. The temperature selector 40 and temperature sensor 32 provides inputs to a heat or temperature controller 42 which, in turn, provides output signals to control the fan 36, heaters 30 and a cycle light 44. The heat controller 42 includes a Wheatstone bridge 48 that includes the resistance of the RTD 32 in one leg thereof. The Wheatstone bridge 48 has the capability of very accurately detecting changes in the resistance of the RTD and thus, of the temperature of the heat transfer block 22. A preamplifier 50 receives an output signal from the Wheatstone bridge 48 and provides an amplified input into an A/D converter 52. A suitable preamplifier 50 is manufactured by Analog Devices and is commercially available from Allied Electronics of Cedar Rapids, Iowa as Catalog No. AD626AN or AO626BN. A suitable A/D converter 52 is Model No. TLC2543CN or TLC2543IN commercially available from Avnet EMG of Cedar Rapids, Iowa. The A/D converter 52 provides a digital signal to a microprocessor 54 which is also responsive to selections made by the temperature selector 40. A suitable microcontroller is manufactured by Motorola as Part No. MC68HC711D3CFNZ and is commercially available from Avnet EMG of Cedar Rapids, Iowa. The microcontroller 54 is programmed to execute a proportional-integral-derivative ("PID") control that is a well known device control method that utilizes the input temperature feedback signal from the temperature sensor 32 to provide output command signals to turn the heaters 30 on and off. More specifically, the microcontroller 54 determines the difference between the measured temperature from the sensor 32 and the selected temperature set point from the temperature selector 40 and varies the duty cycle of the power applied to the heaters 30. Typically, if the microcontroller detects that the difference between the measured temperature of the block 22 and the selected temperature set point is greater than 5°, the duty cycle of the heaters is set to 100%. If the temperature difference is less than 5°, the PID control reduces the duty cycle to bring the block 22 to the set point temperature without overshoot. Normally, with the present invention, the microcontroller 54 is operative to turn the fan 36 on and off for periods of time determined by a particular operating cycle being processed by the microcontroller 54. At appropriate times, the microcontroller 54 provides digital output signals to a relay interface 56 which, in turn, provides respective output signals to the fan 36, heaters 30 and cycle light 44. A suitable device for each of the output signals within the relay interface 56 is a solid state relay manufactured by Crydom as Part No. CX24OD5 commercially available from Allied Electronics of Cedar Rapids, Iowa.

The dry bath 20 is intended for use in known processes. For example, if a 41.5° C. setting is selected, the dry bath will expect to receive a load of samples that are approximately 90° C. Therefore, the heat from the samples will tend to warm the heat transfer block 22 above the selected temperature of 41.5° C., and the heat controller 42 must respond to that change in heat block temperature to quickly restore the selected temperature of 41.5° C. to both the heat transfer block 22 and the samples in the tubes 24.

Similarly, if a 60° C. temperature set point is chosen, the dry bath can expect to receive samples having a temperature of about 41.5° C. Thus, the load of samples initially cools the heat transfer block 22, and the heat controller must warm the heat transfer block 22 and samples within the tubes 24 back to the selected 60° C. temperature set point.

Figure 5:
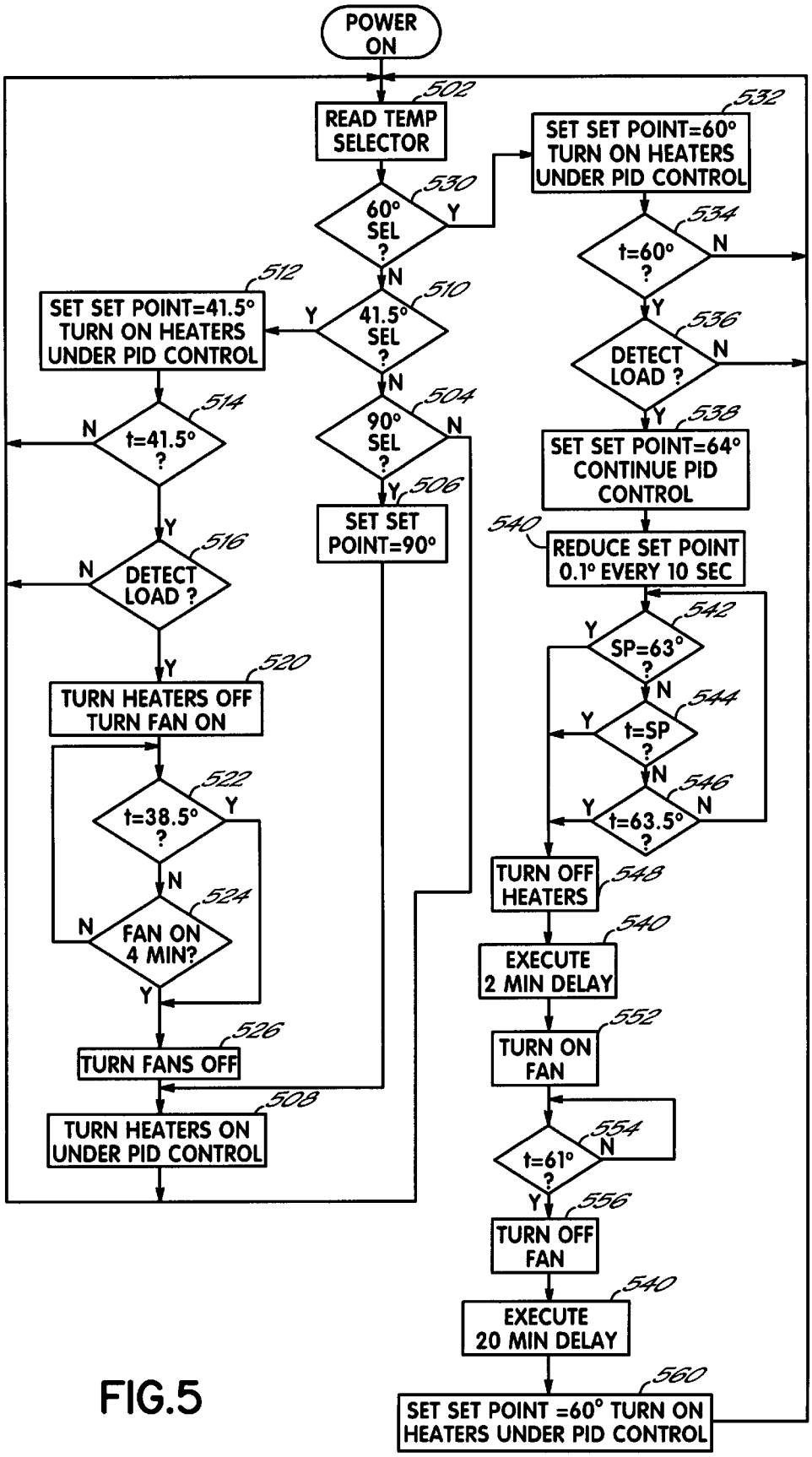
FIG. 5 is a flow chart illustrating the method of temperature control for the temperature settings of the dry bath illustrated in FIG. 1.

Referring to FIG. 5, the heat controller 42 executes different heat control cycles depending on the temperature selected. If the selector 40 is initially set to select a 90° C. temperature, the heat controller 42 executes a cycle to read, at 502, the temperature selected. The heat controller process, at 504, detects the 90° C. selection and, at 506, establishes an internal control temperature set point of 90° C. Thereafter, the heat controller 42 is operative, at 508, to turn the heaters 30 on under the PID control. Under PID control, the heat controller, at 508, will initially detect a significant difference in temperature and immediately turn the heaters on 100% of the time. The cycle light 44 is illuminated by the heat controller 42 during the on-time of the duty cycle, that is, when the heaters are turned on; and the cycle light 44 is off during the off-time of the duty cycle, that is, when the heaters are turned off. Therefore, with a 100% duty cycle, the cycle light 44 is illuminated continuously. The duty cycle stays at 100% until the temperature difference is approximately 5° C. Thereafter, the duty cycle of the heaters 30 is reduced, generally proportional, until the heat transfer block 22 reaches the selected 90° C. temperature. To maintain the heat transfer block 22 and the samples in the tubes 24 at the selected set point temperature, the heat controller maintains the heaters 30 turned on with a fixed, for example, a 30%, duty cycle. That is, over a period of time, power will be applied to the heaters for 30% of that time, and power will be removed from the heaters, thereby turning the heaters off for 70% of that time. As will be appreciated, the duty cycle control can be implemented within a single cycle of the 60 Hertz power signal. The fact that the dry bath has achieved its selected temperature set point is signaled to the operator by the even cycling of the cycle light 44 which is following the duty cycle of the heaters 30. Thus, the PID control method functions to quickly raise the temperature of the heat transfer block 22 and the samples in the tubes 24 to the selected 90° C. set point temperature.

The temperature selector 40 may be used to select a different operating cycle in which it is desired to bring the samples to a temperature of 41.5° C. If the 41.5° C. operating cycle is selected, the heat controller 42 again reads the temperature selector, at 502, and at 510, determines that the current temperature selection is 41.5° C. The heat controller then, at 512, establishes a temperature set point of 41.5° C. Normally, the dry bath is at a cooler room temperature, and the heat controller turns the heaters 30 on under PID control. The heaters are operative to warm the heat transfer block 22 to the 41.5° C. temperature set point which is detected, at 514 of FIG. 5. With the temperature of the heat transfer block 22 stabilized at 41.5° C., the PID control is turning the heaters on and off at a constant, for example, 20%, duty cycle. The fact that the dry bath block 22 has achieved the desired temperature set point of 41.5° C. is evidenced by the cycling of the light 44.

Upon observing the even cycling of the light 44, the operator knows that the dry bath is at the selected temperature and is ready to accept a load of tubes 24 containing the samples. With the 41.5° C. selection, the dry bath 20 can expect that the samples in the tubes 24 will have a temperature of approximately 90° C. Upon the samples being inserted into the block 22 of the dry bath, the temperature of the heat transfer block 22 immediately begins to rise. The PID control cycle operating within the heat controller 42 decreases the duty cycle of the heaters 30, thereby providing less heat to the heat transfer block 22. In addition, the heat controller 42, at 516, detects when the temperature of the heat transfer block 22 rises to 42° C., thus indicating to the heat controller 42 that samples in the tubes 24 have been loaded into the heat transfer block 22 of the dry bath 20. Upon detecting the 42° C. temperature, the PID control within the heat controller 42, at 520, then sets the duty cycle of the heaters 30 to zero, thereby turning the heaters 30 off and provides an output signal to turn the fan 36 on. The fan 36 runs until the heat controller 42 detects, at 522, that the temperature of the heat transfer block 22 is 38.5° C. or, at 524, that the fan 32 has been on for four minutes. In response to either of those events, the heat controller 42 then, at 526, turns the fan 32 off, and at 508, the heaters 30 are turned on to operate under PID control with the temperature set point of 41.5° C.

Figure 6:
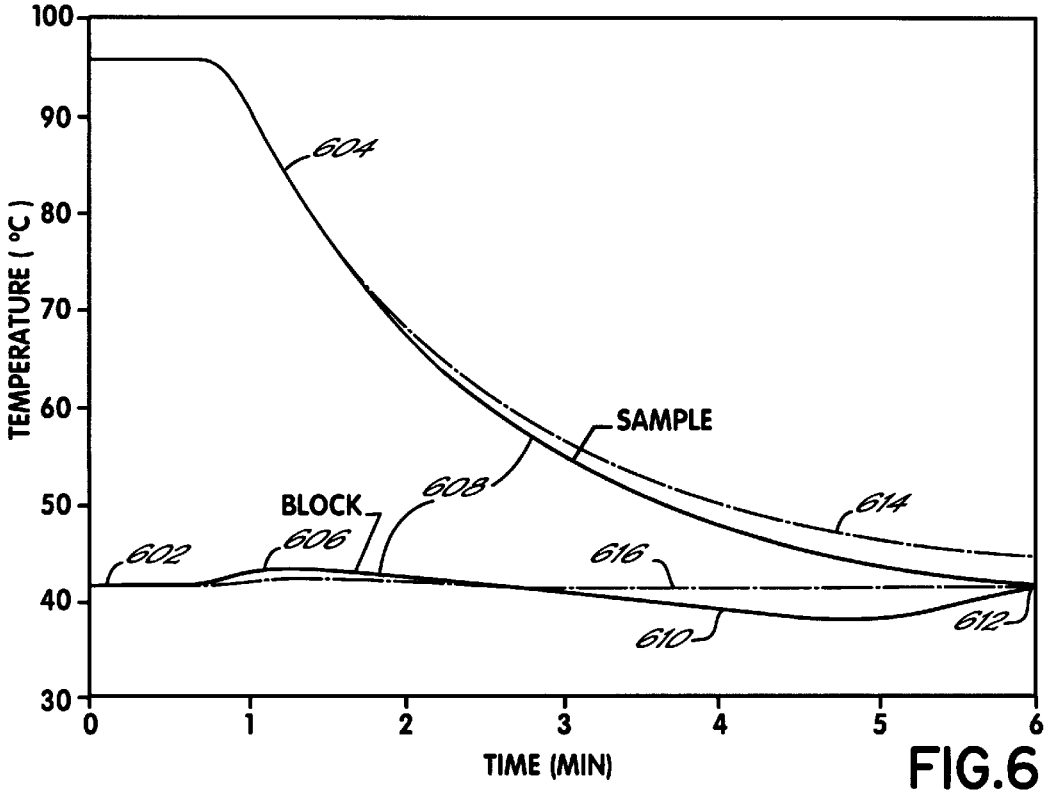
FIG. 6 is a graph plotting changes in temperature of the samples and the heat block during a first cycle of operation of the dry bath of FIG. 1.

Referring to FIG. 6, the heat controller 42 is executing the operating cycle for the 41.5° C. selection and initially brings the heat transfer block to the selected set point temperature of 41.5° C., at 602. When the samples are loaded into the block 22, the temperature of the samples immediately begins to decrease, at 604, and the temperature of the block increases, at 606. Upon detecting the increase in block temperature, the heat controller 42 turns on the fan 36 to further promote the cooling of the samples and the block 22, at 608. Further, and very importantly, the temperature of the heat transfer block 22 is allowed to drop below of the set point temperature of 41.5° C., at 610, however, the samples are still above the set point temperature. By permitting the block 22 to drop below the set point temperature, a larger temperature differential is created between the heat transfer block 22 and the samples in the tubes 24 at a temperature close to the selected temperature. That increased temperature differential increases the rate of heat transfer from the samples to the block 22 at a temperature near the selected temperature, thereby shortening the time required for the samples to reach the selected temperature. However, the operating cycle of the heat controller 42 is selected so that the temperature of the samples in the tubes 24 does not exceed, or in this example, go below the selected temperature of 41.5° C. Upon detecting a lower temperature of 38.5° C. of the block 22, the heat controller 42 then operates the heaters under PID control so that the samples and the heat transfer block reach a temperature substantially equal to the desired set point temperature at substantially the same time, at 612. Thus, the heat controller is very effective to quickly bring the temperature of the samples within the tubes 24 to the 41.5° C. selected temperature set point without overshoot. The performance of the above described heat control cycle is very repeatable and is independent of the load, that is, the number of samples loaded into the dry bath 20.

The above described operating cycle brings the samples to the selected set point temperature more quickly than prior systems which maintain the heat transfer block 22 at the set point temperature as represented by the sample temperature curve 614 and block temperature curve 616 both of which are shown in phantom. At 612, the sample temperature curve 614 is still greater than the block temperature curve 616 which is being maintained at the selected temperature set point. Further, the sample temperature is approaching the block temperature asymptotically, that is, at a relatively slow rate.

The temperature selector 40 may be used to select a third operating cycle in which it is desired to bring the samples to a temperature of 60° C. If the 60° C. operating cycle is selected, the heat controller 42 detects that selection, at 530. Normally, the dry bath is at a lower ambient temperature; and the heat controller, at 532, establishes a temperature set point of 60° C. and turns the heaters 30 on under the PID control. The heat transfer block 22 is heated to 60° C. as shown, at 702, in FIG. 7, and that temperature is detected, at 534. At that temperature, the controller 42 is operating the heaters 30 under PID control with a duty cycle of approximately 28%. The quiescent state of the dry bath at the selected 60° C. temperature is signaled to the operator by the blinking of the cycle light 44, thus advising the operator that the dry bath 20 is ready to accept a load.

Figure 7:
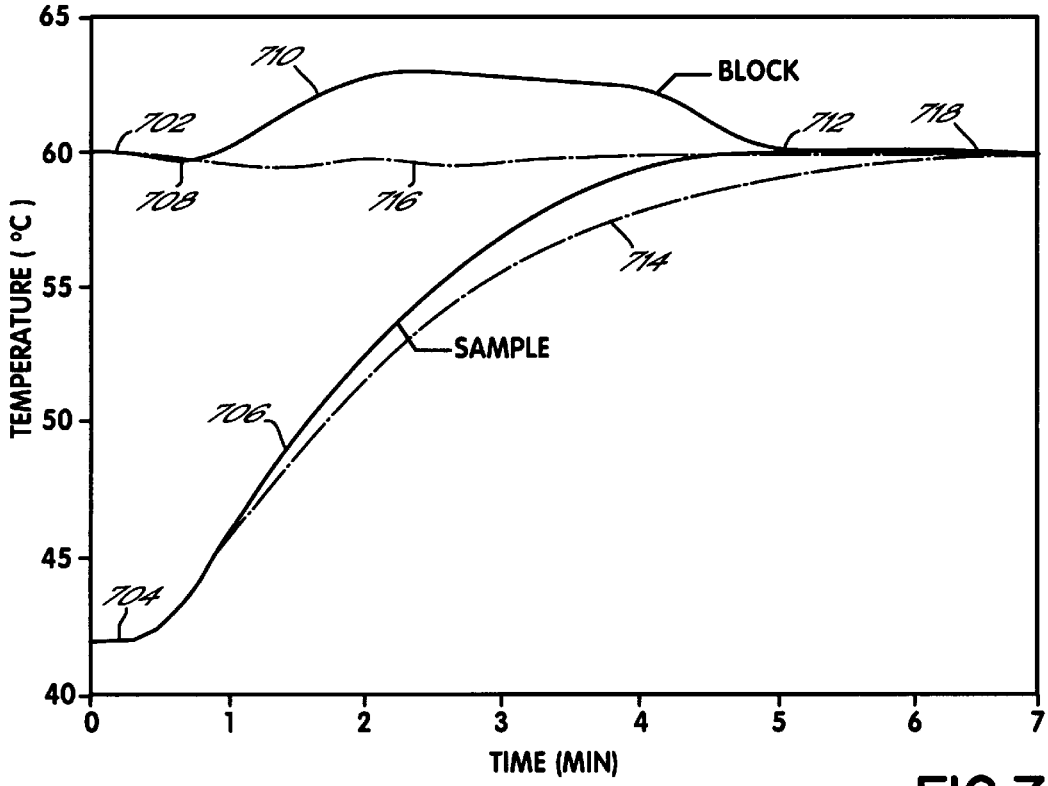
FIG. 7 is a graph plotting changes in temperature of the samples and the heat block during a second cycle of operation of the dry bath of FIG. 1.

With a 60° C. temperature selection, the dry bath 20 can expect that the samples in the tubes 24 will have a temperature of approximately 41.5° C. shown, at 704 of FIG. 7. Therefore, upon loading the samples in the tubes 24 in the dry bath 20, the samples begin to warm and the heat transfer block 22 is initially cooled, see 706 and 708, respectively of FIG. 7. The loading of the samples and the subsequent cooling of the block 22 causes the heat controller 42 to increase the PID duty cycle above the 28% quiescent value. That increase in duty cycle is detected by the heat controller 42, at 536, and is used by the heat controller 42 as being representative of the load of samples. Thereafter, at 538, the heat controller 42 increases the temperature set point from 60° C. to 64° C. and continues operating the heaters 30 under the PID control, thereby heating the heat transfer block 22 toward 64° C. as shown, at 710, in FIG. 7. Thus, the heat controller 42 establishes a set point greater than the selected desired set point and increases the duty cycle of the operation of the heater, thereby heating the heat transfer block 22 to a temperature that exceeds the desired selected temperature while at the same time knowing that the samples in the tubes 24 will not exceed the desired, selected temperature. Again, that greater temperature differential causes a greater rate of heat transfer from the block 22 to the samples in the tubes 24, thereby reducing the time required to heat the samples to the desired selected temperature.

At 540, the heat controller 42 reduces the 64° C. temperature set point 0.1° C. every ten seconds. As the heaters 30 continue operating under PID control and the temperature set point is reduced, the heater controller 42 then checks for the occurrence of one of three conditions. First, at 542, the controller 42 detects whether the temperature of the heat transfer block 22 is equal to the current set point temperature. Further, at 544, the controller 42 checks whether the current temperature set point is equal to 63° C. Third, at 546, the controller 42 also detects whether the temperature of the heat transfer block is equal to 63.5° C. Upon the occurrence of any of the above three conditions, the heat controller 42 then reduces the duty cycle of the heaters to zero, thereby turning the heaters 30 off, at 548, and executes a two minute delay cycle. After the two minute delay, at 552, the controller 42 turns the fan 36 on. The heat transfer block 22 continues to cool; and when, at 554, the controller 42 detects the temperature of the heat transfer block 22 is 61° C., the controller, at 556, turns the fan 36 off. Then, at 558, the heat controller 42 executes a 20 second delay detected; and thereafter, at 560, the heat controller 42 proceeds to reset the temperature set point to 60° C. and turn the heaters 30 on under PID control. Thus, as shown in FIG. 7, the temperature of the samples in the tubes 24 and the heat transfer block 22 quickly and substantially simultaneously reach a temperature substantially equal to the selected 60° C. temperature set point, at 712. Thus, the heat controller is very effective to quickly bring the temperature of the samples within the tubes 24 to the 60° C. selected temperature set point without overshoot.

The above described operating cycle brings the samples in the tubes 24 to the selected set point temperature of 60° C. more quickly than prior systems which continuously maintain the heat transfer block 22 at the selected set point temperature as represented by the sample temperature curve 714 and block temperature curve 716 both of which are shown in phantom. At 712, the sample temperature of curve 614 is still less than the block temperature curve 716 which is being maintained at the selected temperature set point. Further, the sample temperature is approaching the block temperature at a slower asymptotic rate and does not reach the block temperature until a later time 718, thereby resulting in a longer operating cycle to bring the samples to the selected set point temperature.

The present invention provides an improved dry bath temperature control that quickly changes the temperature of samples to be approximately equal to the selected temperature. The heat controller 42 recognizes that the temperature of the samples in the tubes 24 lags the temperature of the heat transfer block 22 supporting the tubes 24. Further, in a cycle in which the samples are heated, the heat controller 42 increases the temperature of the heat transfer block 22 above the selected temperature for a short period of time to increase the rate of heat transfer from the block 22 to the samples in the tubes 24, thereby shortening the time required for the samples to reach the selected temperature. In addition, the heat controller 42, in a timely manner, then lowers the temperature of the heat control block 22 so that the heat control block 22 drops to the selected temperature at the same time that the samples in the tubes 24 are raised to the selected temperature, thereby preventing the samples from exceeding the selected temperature.

A similar method is followed in a cycle in which the samples in the tubes 24 are to be cooled. That is, the heat transfer block 22 is lowered to a temperature lower than the selected temperature to increase the rate of heat transfer from the samples to the block 22; and thereafter, the temperature of the heat transfer block 22 is raised, so that the heat transfer block 22 and the samples in the tubes 24 reach the selected set point temperature at the same time.

Thus, the dry bath of the present invention has the advantage of using a temperature sensor 32 measuring the temperature of the heat transfer block 22 to control the heat transfer cycle but achieves the same operating cycle efficiency as if the temperature sensor 32 were located in the tubes and measuring the temperature of the samples directly. Further, the heat controller 42 has the further advantage of producing temperature changes in the dry bath that are similar to the heat transfer characteristics of a water bath without its disadvantages such as its greater expense, potential cross-contamination issues, and the potential that water will escape the confines of the water bath.

While the present invention has been illustrated by a description of various embodiments, and while these embodiments have been described in considerable detail, it is not the intention of Applicants to restrict or in any way limit the scope of the appended claims to such detail. Additional advantages and modifications will readily appear to those skilled in the art. For example, the temperature sensor 34 is shown as being disposed within the heat transfer block 22; however, as will be appreciated, other temperature sensors, for example, infrared temperature sensors, may alternatively be used. If the temperature sensor 32 is an infrared sensor, it may be mounted adjacent to, but not physically contacting, the heat transfer block 22.

The dry bath described herein has the capability of a user selecting different desired temperatures for the dry bath. As will be appreciated, the invention described herein is applicable to a dry bath having only one temperature cycle and thus, no selector switch. Further, specific references to duty cycle values are illustrative only, and as will be appreciated, a PID control would be set up differently by different people in order to perform the same functions as described herein.

While the bores 25 in the block 22 are described as blind holes, as will be appreciated, in some heat transfer block designs, the bores 25 may be through holes. Further, the cycle light 44 is described as providing a consistent blinking operation in response to the heat transfer block being heated to the temperature set point. Alternatively, the light 44 may be replaced by any other indicator providing a signal that is visual, aural, tactile or otherwise detectable by animal senses. In addition, while a cooling fan is illustrated, one or more fans may be used; or alternatively other cooling devices may be used.

Thus, the invention in its broader aspects is not limited to the specific details, representative apparatus and method, and illustrative example shown and described. Accordingly, departures may be made from such details without departing from the spirit or scope of Applicants' general inventive concept.

What is claimed is:

1. A dry bath comprising:

a heat conductive block having a plurality of bores adapted to receive tubes containing samples of material;

a heater mounted in heat transfer relation to the heat conductive block and operative when energized to add heat to the heat conductive block;

a temperature sensor mounted in heat transfer relation to the heat conductive block for sensing the temperature of the heat conductive block; and a heat controller connected to the heater and the temperature sensor and executing a control cycle of automatically detecting a decrease in the temperature of the block in response to the tubes containing samples being placed in the block, wherein the samples in the tubes have a temperature less than the desired temperature;

thereafter automatically heating the heat conductive block to a temperature greater than a desired temperature, thereby transferring more heat to the samples in the tubes than if the block were heated to only the desired temperature, and thereafter automatically reducing the heat being applied to the block while heat continues to transfer from the block to the samples such that the block and samples simultaneously reach, and are maintained at, the desired temperature, the samples being heated to the desired temperature more quickly than if the block was maintained at the desired temperature.

2. A dry bath of claim 1 further comprising a cooling device mounted in heat transfer relation to the heat conductive block and operative when energized to remove heat from the heat conductive block.

3. A dry bath of claim 1 further comprising a temperature selector providing an input signal to the controller representing the desired temperature.

4. A dry bath of claim 1 further comprising an indicator responsive to the heat controller for providing a signal upon the block being heated to a temperature approximately equal to the desired temperature.

5. A dry bath of claim 1 wherein the heat controller includes a PID control for controlling the operation of the heater.

6. A dry bath comprising:

a heat conductive block having a plurality of bores adapted to receive tubes containing samples of material;

a heater mounted in heat transfer relation to the heat conductive block and operative when energized to add heat to the heat conductive block;

a cooling device mounted in heat transfer relation to the heat conductive block and operative when energized to transfer heat from the heat conductive block;

a temperature sensor mounted in heat transfer relation to the heat conductive block for sensing the temperature of the heat conductive block; and a heat controller connected to the heater, the cooling device and the temperature sensor and executing a control cycle of automatically detecting an increase in the temperature of the block in response to the tubes containing samples being placed in the block, wherein the samples in the tubes have a temperature greater than the desired temperature;

thereafter automatically cooling the heat conductive block to a temperature less than a desired temperature, thereby transferring more heat from the samples in the tubes than if the block were cooled to only the desired temperature, and thereafter automatically increasing the heat being applied to the block while heat continues to transfer from the samples to the block such that the block and samples simultaneously reach, and are maintained at, the desired temperature, the samples being cooled to the desired temperature more quickly than if the block was maintained at the desired temperature.

7. A method of controlling the temperature of samples in a plurality of tubes disposed in a heat conductive block of a dry bath, the block having a heater under control of a controller which is responsive to a temperature sensor mounted in a heat transfer relation with the heat conductive block, the method of operating the heater under control of the controller comprising:

automatically heating the block to a desired temperature in the absence of the tubes in the block;

thereafter automatically detecting a decrease in the temperature of the block in response to the tubes containing samples being placed in the block, wherein the samples in the tubes have a temperature less than the desired temperature;

thereafter automatically heating the heat conductive block to a temperature greater than the desired temperature, thereby transferring more heat to the samples in the tubes than if the block were heated to only the desired temperature; and thereafter automatically reducing the heat being applied to the block while heat continues to transfer from the block to the samples such that the block and samples reach, and are maintained at, substantially the desired temperature.

8. A method of claim 7 wherein automatically reducing the heat being applied to the block further comprises continuing to transfer heat to the samples such that the block and samples reach the desired temperature at substantially the same time.

9. A method of claim 8 wherein automatically heating the block to a desired temperature further comprises establishing a first temperature set point substantially equal to the desired temperature.

10. A method of claim 9 wherein automatically heating the heat conductive block to a temperature greater than the desired temperature further comprises establishing a second temperature set point greater than the first temperature set point.

11. A method of claim 10 wherein automatically reducing the heat being applied to the block further comprises:

automatically iteratively reducing the second temperature set point in the controller over successive periods of time;

automatically detecting a reduction in the temperature set point to a value intermediate the first and the second temperature set points; and automatically terminating operation of the heater under control of the controller in response to detecting the reduction in the temperature set point value.

12. A method of claim 11 wherein detecting a reduction in the temperature set point further comprises detecting a reduction in the temperature set point to a value intermediate the first and the second temperature set points but closer to the second temperature set point.

13. A method of claim 10 wherein automatically reducing the heat being applied to the block further comprises:

automatically iteratively reducing the second temperature set point in the controller over successive periods of time;

automatically detecting a temperature of the block being substantially equal to a current value of the second temperature set point; and automatically terminating operation of the heater under control of the controller in response to detecting the temperature of the block being substantially equal to a current value of the second temperature set point.

14. A method of claim 10 wherein automatically reducing the heat being applied to the block further comprises:

automatically iteratively reducing the second temperature set point in the controller over successive periods of time;

automatically detecting temperature of the block having a value intermediate the first and the higher temperature set points; and automatically terminating operation of the heater under control of the controller in response to detecting the reduction in the temperature set point value.

15. A method of claim 14 wherein detecting a temperature of the block further comprises detecting temperature of the block having a value slightly less than the second temperature set point.

16. A method of claim 7 wherein a cooling device is operatively connected to the controller and after terminating operation of the heater, the method further comprises selectively operating the heater and the cooling device to cause the temperatures of the block and the samples to become substantially equal to the desired temperature at substantially the same time.

17. A method of claim 16 wherein selectively operating the heater and the cooling device further comprises:

terminating operation of the heater and initiating operation of the cooling device;

detecting a block temperature greater than the first temperature set point; and thereafter, terminating operation of the cooling device.

18. A method of claim 17 further comprising delaying the initiation of the operation of the cooling device for a period of time after terminating the operation of the heaters.

19. A method of claim 18 further comprising initiating operation of the heater after terminating operation of the cooling device.

20. A method of claim 19 further comprising delaying initiating operation of the heater for a period of time after terminating operation of the cooling device.

21. A method of controlling the temperature of samples in a plurality of tubes disposed in a heat conductive block of a dry bath, the block having a heater under control of a controller which is responsive to a temperature sensor mounted in a heat transfer relation with the heat conductive block, the method of operating the heater under control of the controller comprising:

automatically heating the block to a desired temperature in the absence of the tubes in the block;

thereafter automatically detecting a decrease in the temperature of the block in response to the tubes containing samples being placed in the block, wherein the samples in the tubes have a temperature less than the desired temperature; and thereafter automatically controlling the operation of the heater to first, heat the block to a temperature in excess of the desired temperature and second, reduce the heat being applied to the block while heat continues to transfer from the block to the samples such that the block and samples simultaneously reach, and are maintained at, the desired temperature, the samples being heated to the desired temperature more quickly than if the block was maintained at the desired temperature.

22. A method of controlling the temperature of samples in a plurality of tubes disposed in a heat conductive block of a dry bath, the block having a heater under control of a controller which is responsive to a temperature sensor mounted in a heat transfer relation with the heat conductive block, the method of operating the heater under control of the controller comprising:

automatically heating the block to a desired temperature in the absence of the tubes in the block;

thereafter automatically detecting a decrease in the temperature of the block in response to the tubes containing samples being placed in the block, wherein the samples in the tubes have a temperature less than the desired temperature; and thereafter automatically controlling the duty cycle of the heater to first, set the duty cycle be greater than a duty cycle determined by the function of the temperature difference between the temperature detected by the temperature sensor and the desired temperature, thereby heating the block to a temperature in excess of the desired temperature and second, set the duty cycle be equal to a duty cycle determined by the function of the temperature difference between the temperature detected by the temperature sensor and the desired temperature, thereby reducing the heat being applied to the block while heat continues to transfer from the block to the samples such that the block and samples simultaneously reach, and are maintained at, the desired temperature.

23. A method of controlling the temperature of samples in a plurality of tubes disposed in a heat conductive block of a dry bath, the block having a cooling device and a heater under control of a controller which is responsive to a temperature sensor mounted in a heat transfer relation with the heat conductive block, the method of operating the cooling device and the heater under control of the controller comprising:

automatically bringing the block to a desired temperature in the absence of the tubes in the block;

thereafter automatically detecting an increase in the temperature of the block in response to the tubes containing samples being placed in the block, wherein the samples in the tubes have a temperature greater than the desired temperature;

thereafter automatically cooling the heat conductive block to a temperature less than the desired temperature, thereby transferring more heat from the samples in the tubes than if the block were cooled to only the desired temperature; and thereafter automatically increasing the heat being applied to the block while heat continues to transfer from the samples to the block such that the block and samples reach, and are maintained at, the desired temperature.

24. A method of claim 23 wherein automatically reducing the heat being applied to the block further comprises continuing to transfer heat from the samples such that the block and samples reach the desired temperature at substantially the same time.

25. A method of claim 24 wherein automatically bringing the block to a desired temperature further comprises establishing a first temperature set point substantially equal to the desired temperature.

26. A method of claim 23 wherein automatically increasing the heat being applied to the block further comprises:

automatically terminating operation of the heater and operating the cooling device to cool the heat conductive block and the samples in the tubes, thereby decreasing their respective temperatures; and automatically terminating operation of the cooling device and operating the heater in response to detecting a temperature of the block being less than the desired temperature.

27. A method of claim 23 wherein automatically increasing the heat being applied to the block further comprises:

automatically terminating operation of the heater and operating the cooling device to cool the heat conductive block and the samples in the tubes, thereby decreasing their respective temperatures; and automatically terminating operation of the cooling device and operating the heater in response to detecting a period of time after terminating the operation of the heaters.

28. A method of controlling the temperature of samples in a plurality of tubes disposed in a heat conductive block of a dry bath, the block having a cooling device and a heater under control of a controller which is responsive to a temperature sensor mounted in a heat transfer relation with the heat conductive block, the method of operating the cooling device and the heater under control of the controller comprising:

automatically bringing the block to a desired temperature in the absence of the tubes in the block;

thereafter automatically detecting an increase in the temperature of the block in response to the tubes containing samples being placed in the block, wherein the samples in the tubes have a temperature greater than the desired temperature; and thereafter automatically controlling the operation of the cooling device and the heater to first, cool the block to a temperature less than the desired temperature and second, increase the heat being applied to the block while heat continues to transfer from the samples to the block such that the block and samples simultaneously reach, and are maintained at, the desired temperature, the samples being cooled to the desired temperature more quickly than if the block were cooled to only the desired temperature.

* * * * *